United States Patent [19]

Larsson et al.

[11] 4,064,723

[45] Dec. 27, 1977

[54] HYDROSTATIC EXTRUSION PRESS

[75] Inventors: Hans Gunnar Larsson; Erik Westman, both of Vasteras, Sweden

[73] Assignee: Allmanna Svenska Elektriska Aktiebolaget, Vasteras, Sweden

[21] Appl. No.: 700,790

[22] Filed: June 29, 1976

[30] Foreign Application Priority Data

July 18, 1975 Sweden ..... 7508221

[51] Int. Cl.[2] ..... B21D 22/10

[52] U.S. Cl. ..... 72/60; 72/272; 72/DIG. 31

[58] Field of Search ..... 72/60, 63, 56, 272, 72/271, DIG. 31, DIG. 8, 463, 468

[56] References Cited

U.S. PATENT DOCUMENTS

| | | | |
|---|---|---|---|
| 2,002,690 | 5/1935 | Carter | 72/463 X |
| 3,364,707 | 1/1968 | Foerster | 72/463 X |
| 3,392,562 | 7/1968 | Fuchs, Jr. | 72/60 |
| 3,434,320 | 3/1969 | Green | 72/60 |

*Primary Examiner*—Leon Gilden

*Attorney, Agent, or Firm*—Watson, Cole, Grindle & Watson

[57] ABSTRACT

In a press for hydrostatic extrusion, the die has a conical inlet portion and a portion forming a die opening. The die has draining channels which bypass the smallest cross-section of the die opening for the purpose of intercepting and diverting pressure medium which accompanies the billet as it moves down towards the smallest cross-section of the die. This removes any pressure medium which might otherwise pass through the die opening and damage the surface of the extruded article.

7 Claims, 4 Drawing Figures

HYDROSTATIC EXTRUSION PRESS

BACKGROUND OF THE INVENTION

1. Field of the Invention

The present invention relates to a hydrostatic extrusion press and to the structural features of a die useful therein. The press is particularly designed for extruding non-round products, in particular to compound products having a core of one material and a casing of another material, such as copper-clad aluminium bars.

2. The Prior Art

In the extrusion of copper-clad aluminium bars, irregularities will in certain cases appear at the surface as a result of the fact that pressure medium on the billet surface accompanies this surface from the pressure chamber down into the die and is collected between the die surface and the billet surface. When a certain quantity has been collected between the billet surface and the die surface at the portion nearest the die opening, the pressure medium is pressed out through the die opening between its inner surface and the material of the billet. Because of the high pressure, the pressure medium is pressed out at a great speed and causes damage in the form of spots on the surface of the product or, in the worst case, breaks through the copper layer. The problems seem to be most prominent in the extrusion of profiles with a high aspect ratio, and in the case of a small extrusion ratio.

SUMMARY OF THE INVENTION

By means of the invention the above-mentioned drawbacks can be eliminated. A major accumulation of pressure medium is prevented because the die is designed with a drainage channel which passes by the smallest cross-section of the die opening, and which intercepts and successively carries away the pressure medium which accompanies the billet more than half the way through the inlet portion of the die down towards the part with the smallest cross-section, this cross-section determining the dimensions of the product. The intermittent passage of pressure medium through the die opening between its wall and the surface of the product, which occurred occasionally in previous designs of dies, is avoided. In a die which is designed in one piece, the drainage channel may consist of a bored channel opening out at the lower portion of the inlet portion of the die, that is, in the vicinity of the smallest cross-section of the die, and in a space outside the pressure chamber where the pressure is lower than in the pressure chamber. The die can be composed of two parts, an inlet and preforming part and an end forming part which includes the die opening. Drainage grooves are then arranged in a surface in one die portion which makes contact with a surface of the other die portion. The end forming part may be formed on one side with one or more grooves which open out radially inside the inlet and preforming part and the other end of which opens out at the periphery and communicates through other grooves with a space outside the die. These other grooves are arranged axially at the periphery of the die part and in the surface abutting a die support. It is also possible, instead of grooves in the side of the die facing the die support, to arrange grooves in the die support. It is further possible to arrange a groove in the surface of the die which starts in the preforming part and passes the smallest cross-section.

BRIEF DESCRIPTION OF THE DRAWINGS

The invention will be described in more detail with reference to the accompanying drawings.

DESCRIPTION OF THE PREFERRED EMBODIMENTS

Figure 1:
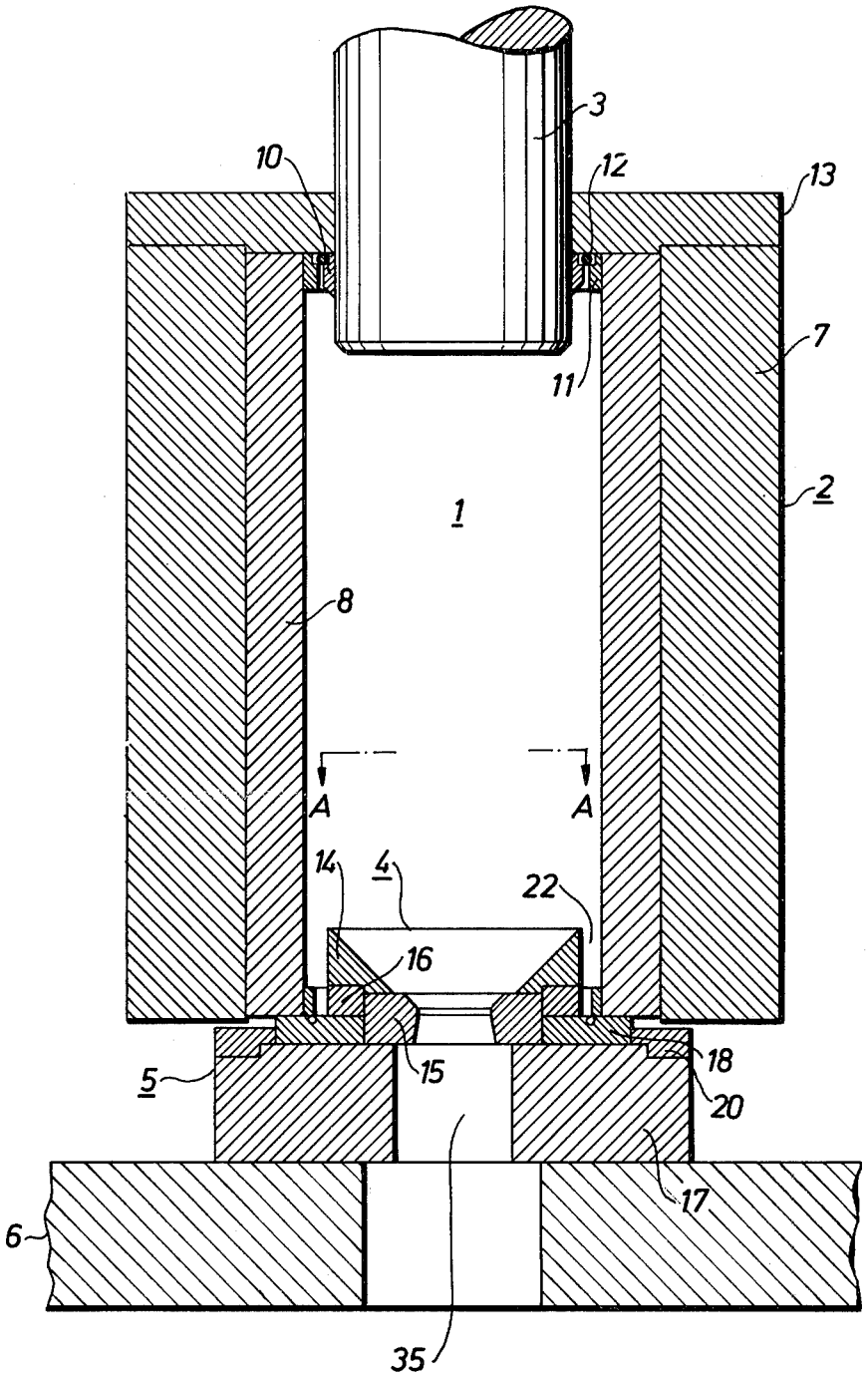
FIG. 1 shows schematically a pressure chamber in a hydrostatic extrusion press in longitudinal section, FIG. 2 on a larger scale a section of a portion at the die end, FIG. 3 a view of the die along the line A—A in FIG. 1, and FIG. 4 a section through the die along the line B—B in FIG. 3.
Figure 2:
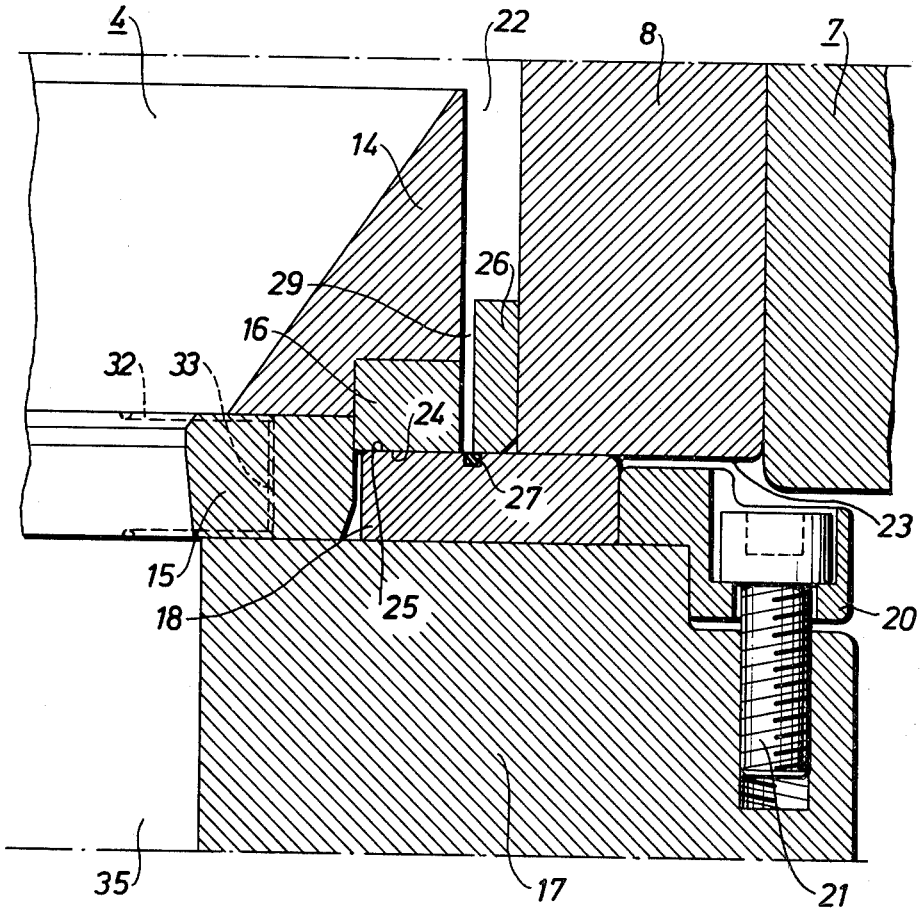
Figure 3:
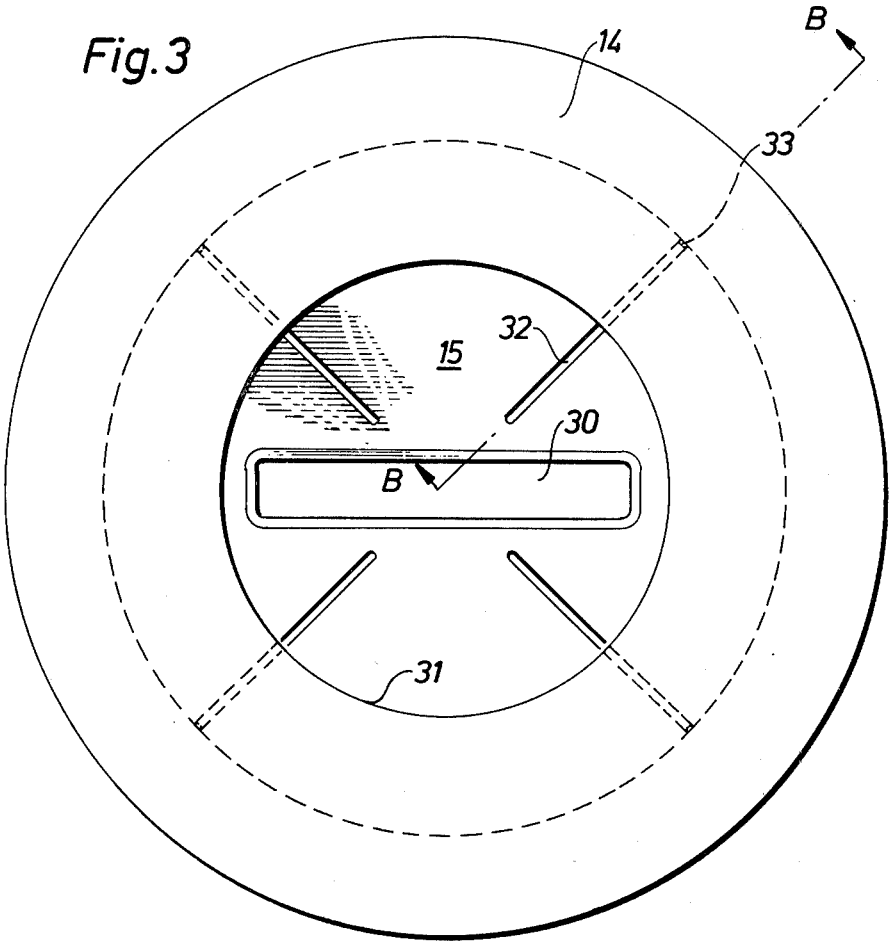
Figure 4:
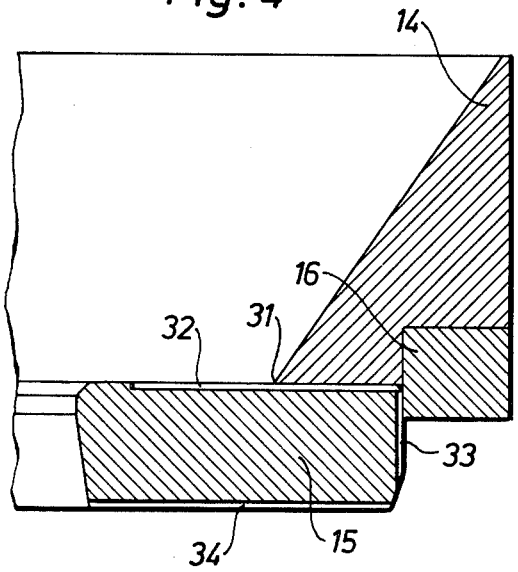

In the figures, 1 designates a pressure chamber which is composed of a high-pressure cylinder 2, a pressure-generating piston 3, a die 4 and a die support 5 resting against a yoke 6 in a press, the rest of which is not shown. The high-pressure cylinder 2 contains a cylinder 7, which may be built up in a manner known per se of a tube and prestressed wires or tapes wound around the tube, and a liner 8 inserted in the cylinder 7. Between the piston 3 and the liner 8 there is a seal consisting of two metal rings 10 and 11 and an O-ring 12. The end piece 13 of the cylinder 2 also forms a support for the seal. The die 4 consists of a preforming part 14, an end forming and calibrating part 15, and of a suitably prestressed ring 16 holding these two parts together. The die support 5 contains a strong, annular portion 17, an exchangeable support ring 18 and an attachment ring 20 arranged in a prestressed manner around the support ring 18, the attachment ring 20 being joined to the part 17 by a number of bolts 21. The ring 18 of the die support bridges the gap 22 between the parts 14 and 16 of the die and the liner 8. The ring 18 is pressed against the end surface 23 of the liner 8. The end surface 24 of the die ring 16 makes contact in a sealing manner with the upper surface 25 of the ring 18. In the gap 22 there is a metallic sealing ring 26, the outer surface of which abuts the ring 18 of the die support. Between the sealing ring 26 and the parts 14 and 16 of the die there is a space 29. In a slot in the ring 18 there is an elastic sealing ring 27 for effecting initial sealing.

The opening 30 of the die portion 15 is rectangular with a relatively great ratio between height and width. The smallest diameter 31 of the inlet and performing part 14 is larger than the greatest dimension of the die opening. Between the preforming part 14 and the die opening 30 there is a plane surface. At the upper surface of the end forming part there are grooves 32. These emanate from the periphery of the die part 15 and end inside the smallest diameter 31 of the die part 14. One end of a channel formed by the groove 32 between parts 14 and 15 thus opens out inside the die between the die opening and the innermost part of the die. At the periphery of the part 15 there are axial grooves 33 so that a channel is formed between the die parts 15 and 16. Further, on the under side of the die part 15 there are grooves 34 so that a channel is formed between the die part 15 and the support part 17. This channel ends in the opening 35 in the die support. One end of the draining channel of the die opens out into the die, as mentioned, and its other end opens out into the opening 35 where the pressure is equal to the atmospheric pressure.

Pressure medium which is present on the surface of an extrusion billet and accompanies the billet down into the die and which, because of changed pressure conditions during the passage through the die forms an accumulation between the billet and the die surface, is allowed to flow out through the draining channels instead of being pressed out periodically through the die opening and thus cause damage to the pressed product.

We claim:

1. A press for hydrostatic extrusion which comprises means forming a pressure chamber, a die mounted at one end of the pressure chamber having a passageway therein and including a conical inlet portion and a die-opening portion, said die-opening portion including an internal opening for forming a billet which is forced therethrough from inside the pressure chamber by a pressure medium to form a product of desired cross-section, said internal opening in said die-opening portion having the smallest cross-section in said passageway, said die including draining channel means which communicates between said passageway adjacent a lower part of said inlet portion of said die and a space outside of said pressure chamber which is at a pressure lower than the pressure of said passageway so as to by-pass said internal opening of said die-opening portion and act to intercept and divert any pressure medium which accompanies the billet more than halfway through the passageway in the inlet portion of the die as it passes therethrough such that intermittent passage of pressure medium through said internal opening is prevented.

2. A press according to claim 1, wherein said draining channel means comprises a bored channel, one end of which communicates with said passageway, and the other end of which communicates with the outside space.

3. A press according to claim 2, wherein said other end of said bored channel communicates with said passageway on the opposite side of said internal opening.

4. A press according to claim 2, wherein said draining channel means comprises at least two of said bored channels.

5. A press according to claim 2, wherein said die-opening portion includes a top surface adjacent said conical inlet portion, a side surface, and a bottom surface opposite said top surface, and wherein said draining channel means comprises at least one groove in said top surface and at least one groove in communication therewith in said side surface.

6. A press according to claim 5, wherein said at least one groove in said top surface communicates with said passageway in a radial direction.

7. A press according to claim 1, wherein the narrowest portion of said passageway in said inlet portion of said die is larger than said passageway in said die-opening portion.

* * * * *